US007407061B2

(12) United States Patent
Fares et al.

(10) Patent No.: US 7,407,061 B2
(45) Date of Patent: Aug. 5, 2008

(54) BEVERAGE CAN WITH A RECLOSEABLE OPENING

(76) Inventors: Abdel Nasser Fares, 4 K Alexandre Dumas, Epinay S/ Seine, F-93800 (FR); Mourad Boutebakh, 9 rue Lamartine, Stains, F-93240 (FR)

( * ) Notice: Subject to any disclaimer, the term of this patent is extended or adjusted under 35 U.S.C. 154(b) by 479 days.

(21) Appl. No.: 10/482,944

(22) PCT Filed: Jul. 4, 2002

(86) PCT No.: PCT/FR02/02327

§ 371 (c)(1),
(2), (4) Date: Mar. 18, 2004

(87) PCT Pub. No.: WO03/004365

PCT Pub. Date: Jan. 16, 2003

(65) Prior Publication Data

US 2004/0259235 A1 Dec. 23, 2004

(30) Foreign Application Priority Data

Jul. 5, 2001 (FR) ..... 01 08921

(51) Int. Cl.
*B65D 17/34* (2006.01)

(52) U.S. Cl. ..... 220/254.4; 220/269; 220/906

(58) Field of Classification Search ..... 220/254.1, 220/254.4, 254.7, 269, 906
See application file for complete search history.

(56) References Cited

U.S. PATENT DOCUMENTS 3,559,843 A 2/1971 Kern (Continued)

FOREIGN PATENT DOCUMENTS

DE 2715890 10/1978

(Continued)

*Primary Examiner*—Anthony D Stashick
*Assistant Examiner*—James N Smalley
(74) *Attorney, Agent, or Firm*—Jordan and Hamburg LLP

(57) ABSTRACT

The invention relates to a container with a closing device. Said container comprises a base, a lid (C) and a vertical partition joining the base and the lid, a tongue element comprising a grip end (4) and an opposite bearing end (8), said tongue element (4,8) comprising a lug (3), being integral with the lid (C) by means of a plug (2) fixed to the lid (c). The tongue can be rotationally displaced around the longitudinal axis XX of the plug (2) and can be inclined at a certain angle α in relation to the plane of the lid, an opening zone (1) being defined by a precut (10) in said lid (C) and being able to be opened using the tongue, whereby the bearing end thereof (8) exerts a force from the outside to the inside of the container on said area (1) defined by the precut (10). The tongue is such that the grip end thereof (8) has a closing/opening area (7) which is originally convex and which can be deformed, as a result of the flexibility and elasticity thereof, by a pushing movement from the outside to the inside of the container in order to take on a concave shape and vice-versa, being able to be deformed in order to revert to a convex shape by pressing the inside towards the outside of the container on the bearing edge. The invention can be used in containers, especially beverage containers.

7 Claims, 1 Drawing Sheet

U.S. PATENT DOCUMENTS

| | | | | | |
|---|---|---|---|---|---|
| 3,938,693 | A | * | 2/1976 | Patel et al. | 222/81 |
| 4,433,792 | A | * | 2/1984 | Mandel | 220/269 |
| 4,442,950 | A | * | 4/1984 | Wilson | 220/269 |
| 4,463,866 | A | * | 8/1984 | Mandel | 220/269 |
| 4,720,022 | A | * | 1/1988 | Gomes | 220/269 |
| 4,821,912 | A | | 4/1989 | Wells | |
| 4,887,712 | A | * | 12/1989 | Wells | 206/269 |
| 4,951,835 | A | * | 8/1990 | DeMars et al. | 220/269 |
| 5,743,445 | A | * | 4/1998 | Benarrouch | 222/541.9 |
| 5,813,559 | A | * | 9/1998 | Cho | 220/258.2 |
| 6,059,137 | A | * | 5/2000 | Westwood et al. | 220/258.2 |
| 6,098,830 | A | * | 8/2000 | Jamieson | 220/259.1 |
| 6,220,470 | B1 | * | 4/2001 | McHenry et al. | 220/254.4 |
| 6,427,861 | B1 | * | 8/2002 | Cho | 220/269 |

FOREIGN PATENT DOCUMENTS

| | | |
|---|---|---|
| DE | 3703875 | 8/1988 |
| DE | 40 35 395 | 5/1992 |
| DE | 29615277 | 1/1997 |
| DE | 29617664 | 3/1997 |
| DE | 199 12 880 | 1/2000 |
| WO | WO- 00/01587 | 1/2000 |

* cited by examiner

BEVERAGE CAN WITH A RECLOSEABLE OPENING

BACKGROUND OF THE INVENTION

This Invention concerns a device ensuring the alternating opening and closing of a self-opening container, more specifically a container for liquid or a container for a mixture of solid and liquid, or a container for a solid product. A device of this kind may be used as a container for food liquids, for instance drinks such as beer, tea, milk, drinks based on fruit juice, on tea, on sparkling water, lemonades, soups, sauces or as a container for foodstuffs consisting of mixtures of liquids and solids, for instance culinary preparations based on fish and sauce, on meat and source, preparations based on milk products and fruit, jams or honey, or as a container for solid products such as pastes, mixed salads, animal feed, etc.

Self-opening containers are already well known and that are widely used in modern society, available on a widespread basis in the trade. Such containers consist of a flat bottom and a flat upper lid connected by a vertical wall. More often than not they are made of stainless steel or white metal or aluminium, or any other appropriate metal or alloy. The material forming the container is a metal sheet having some flexibility and which, when warped by a certain amount of force, returns to its initial position. Up to a force limit, the sheet of material maintains its elasticity and returns to its initial shape. It is only warped temporarily. When said force limit is exceeded, the sheet of metal loses its elasticity and is definitively warped. The bottom and lid may be of a circular, oval, square, rectangular, trapezoidal or of another shape.

These containers, on the upper lid, have a cutout of a suitable shape, for instance, round, oval, etc, which must be opened by pushing from the outside toward the inside. The pushing force is applied by the pointed end of a tab whose other end, referred to as the gripping end, is raised from the inside toward the outside by the user. When the bearing end of the tab bears on the cutout, it gives way and the area formed by the cutout then opens. This tab is made integral with the lid by means of a contact. However, it is evident that this contact allows the swivelling of the tab about the contact, along the longitudinal axis of the contact, so that the bearing end of the tab may rotate through 180° about this axis, then bringing the gripping end of the tab opposite the cutout area. In general, at the end of the gripping tab there is a hole allowing the user to insert a fingertip to pull the tab to the outside and therefore, by the tilting of the tab, apply the bearing end of the tab to the area delimited by the cutout.

The area delimited by the cutout may be pressed toward the inside of the container. In this case, the tab is placed outside of the area delimited by the cutout and only the bearing end is above the area delimited by the cutout.

The area delimited by the cutout may be pulled toward the outside. In this case, the tab is placed entirely inside the area delimited by the cutout.

This type of device offers the advantage of easier container opening and dispenses with the need for a specific can opener.

However, one major drawback of these devices represented by a previous technical embodiment is that, once opened, they cannot be closed again.

Accordingly, their contents must be used immediately or if used a few hours following its opening, may be denatured. For instance, in the case of fizzy drinks, they may go flat, as well as lose their aromas, and the drink will no longer be suitable for consumption. In the case of a solid product, such as fish preserve, the foodstuffs may undergo fermenting, etc, and what is more, the solid or liquid product may seep from the container.

Therefore, the container's closure, once it had been opened, was sought using the above-described device.

The U.S. Pat. No. 4,887,712, U.S. Pat. No. 4,442,950, WO 00011587, DE A1-199 12 880 and DE-A1-40 35 395 documents describe a self-opening system that may be closed and opened several times in succession. These systems are based on a tab that includes, instead of the hole provided in the gripping end, a lower extra thickness having the shape of the cutout. When the area delimited by the cutout is opened by tipping the tab so that its bearing end presses in the area delimited by the cutout, the user causes the tab to turn 180° about the longitudinal axis of the contact and brings the extra thickness of the tab opposite the opening area delimited by the cutout and presses on the gripping end of the tab, pushing it from top to bottom, so as to engage the extra thickness in the opening area.

Extra thicknesses of this type, provided instead of the gripping hole in the tab, have several drawbacks. The first drawback is that the extra thickness causes the inclination of the tab with respect to the lid so that the bearing end of the tab rests on the cutout area and the gripping end is already raised with respect to the lid of the container. Accordingly, the tab is already brought into an inclined position with respect to the lid of the container. A position like this can cause the inadvertent lifting of the gripping end and, accordingly, the tilting of the tab, then the inadvertent opening of the cutout area.

Another drawback of the lower extra thickness is that the tab includes more material and is therefore more expensive to manufacture.

Another drawback of the lower extra thickness is that in order to prevent the tab from being inclined with respect to the lid, in the initial starting unopened position, there must be a hollow in the lid of the container to accommodate this extra thickness. A hollow of this type is described in the U.S. Pat. No. 4,442,950 documents. Here again, the manufacturing of the container is more complicated and more expensive.

Therefore, the invention has the purpose of remedying the drawbacks of the prior technique.

SUMMARY OF THE INVENTION

One purpose of the intervention is to provide a container closing device that is self-opening; this closing device may be activated and deactivated several times, is reliable, provides sealed closure, easy reopening and is available at low cost.

To this end, the intervention concerns a container having a bottom, a lid, and a vertical wall connecting the bottom to the lid, a tab comprising a gripping end and an opposed bearing end, said tab having a link between the gripping end and the bearing end 8, and being made integral through this link with the lid by means of a contact having a longitudinal axis X-X running parallel to the longitudinal axis of the container, said contact being attached to the lid, said tab having the capability on the one hand of being moved in rotation about the contact longitudinal axis X-X and on the other, of being inclined through a certain angle $\alpha$ with respect to the plane of the lid with an opening area delimited by a cutout insert lid and that may be opened by means of said tab whose bearing end applies force from the outside toward the inside of the container in the area delimited by the cutout.

This container is designed in such a way that:

The gripping end of the tab is enlarged with respect to the shape of the area delimited by the cutout and has a closing/opening area whose size is more or less identical to the area delimited by the cutout, a closing/opening area delimited by a group, and a closing/opening area originally convex in shape and which, because of the flexibility and elasticity of the parts, may be warped by pushing from the outside toward the inside of the container to assume a concave shape and inversely, which may be warped to resume its convex shape by pressing from the inside to the outside of the container using the bearing end;

The attaching contact 2 of link 3 is at a distance from the cutout 10; the groove 5 includes a sealed;

The gripping area 4 also has an outer tab 9, which, once the bearing end 8 of the tab has warped the closing/opening area 7 to bring it into a convex shape, allows the gripping end to the raised so as to open the container C.

The intervention also concerns the process for opening and closing a container as described above by the performing of the following steps:

a) The bearing end of the tab is brought above the cutout area;

b) The end of the tab is raised from the inside the toward the outside of the container so that the bearing end forces the cutout area to open;

c) The tab is made to swivel about the longitudinal axis X-X of the contact to bring in the convex closing/opening area opposite the area delimited by the cutout.

d) Pressure is applied from the outside toward the inside of the container in the convex closing/opening area in order to give it a concave shape;

e) The convex closing/opening area is locked into the opened cutout area so as to close it.

In addition, the following steps are performed:

f) Pressure is applied from the outside toward the inside of the container on the bearing end in order to warp the concave closing/opening area so as to restore it to its initial convex shape; and g) The gripping end is raised by means of a tab 9 in order to release the gripping end and opened the cutout area.

Steps c) to g) are repeated.

The invention also concerns a tab that may be adjusted to a container with an opening area delimited by a cutout.

The tab used for the ultimate opening and closing of the container having an opening area 1 in the lid C delimited by a cutout, including a bearing end, a gripping end and a tab between said the bearing end and said the gripping end, is designed in such a way that the gripping end has an internal closing/opening area delimited by a groove, said closing/opening area being convex and offering flexibility and elasticity allowing it to be warped under the action of an external force so as to assume a concave shape.

The area included between the closing/opening area and the outer edge of the gripping end 8, and the bearing end, are rigid and cannot be warped.

The tab has a grip protruding from the outer edge of the gripping end.

BRIEF DESCRIPTION OF THE DRAWINGS

The following description, with respect to the illustrations attached as non-limited examples, will provide better understanding of how the invention may be used.

DETAILED DESCRIPTION OF THE INVENTION

Figure 1:
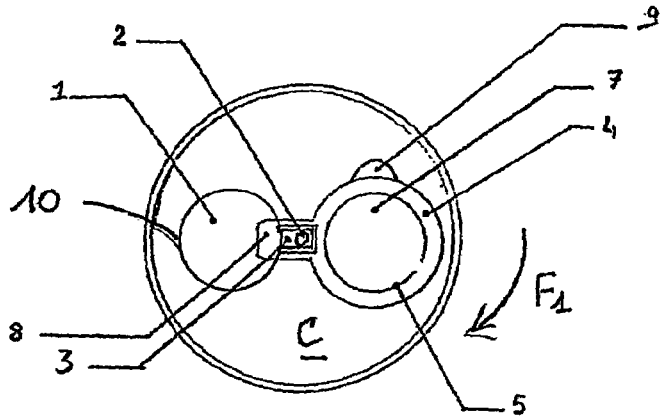
FIG. 1 is a top view of the container lid according to the invention, in the open position.

In FIG. 1, the lid C of a container is shown, comprising a bottom, a lid and a vertical wall connecting the bottom and the lid C. A container like this can be cylindrical, rectangular, in shape, and have a longitudinal axis X-X(see FIG. 2). The container includes a tab comprising a gripping end 4 and an opposed bearing end 8. The tab 4, 8 is made integral with the lid C by a link 2 whose longitudinal axis runs parallel to the longitudinal axis X-X of the container. Contact 2 is attached to the lid C and the tab 4, 8 can be rotated about the longitudinal axis X-X of contact 2 (as shown by the arrow F1) and may be inclined through a certain angle ∞ with respect to the plane of the lid C (see FIG. 3).

An opening area 1 is delimited by a cutout 10 in lid C. This cutout 10 may be opened by means of the tab 4, 8 which includes a bearing end 8 applying force directed from the outside toward the inside of the container in area 1 delimited by cutout 10. The swinging from the outside toward the inside of the container of bearing end 8 is caused by the user pulling the gripping end 4 from the outside toward the inside. The cutout 10 may be of any appropriate shape but preferably, should be oval or circular.

According to the invention, the tab 4, 8 is designed so that its gripping end 4 is enlarged with respect to cutout 10. Gripping end 4 will have an opening/closing area 7 more or less identical to the area delimited by cutout 1. According to an essential characteristic of the invention, the closing/opening area 7, approximately identical to the cutout area 1, will be originally convex; that is, before the container is opened.

According to the invention, tab 4, 8 has a link 3 between its gripping end 4 and its bearing end 8. This link 3 is flexible and elastic and is attached by means of contact 2 to lid C. In this description, the terms of flexible and elastic suggest that the material of which the parts in question is made is a material that can be warped under a certain form of action but which returns to its initial shape as soon as no further force is applied. A material like this may be, for instance, a thin sheet of aluminium or stainless steel, materials often used in industry for manufacturing miscellaneous containers.

According to a prior embodiment, the contact is adjacent to the cutout 10 outside the opening area 1 delimited by cutout 10.

However, according to the invention, the attaching contact 2 of tab 3 is at a distance from the cutout 10, outside the opening area 1. Moving contact 2 in this way, compared to the prior embodiment, becomes necessary because, to close opening 1, a rotation through 180° is performed in the direction of arrow F1 of the tab, it so that the gripping end 4 is brought opposite the opening area 1.

The tab 4, 8 according to the invention is made of a flexible metal alloy having some elasticity. The tab 4, 8 is designed so that its thickness is variable in such a way that the closing/opening area is more flexible than the area outside the closing/opening area 7 and so that the bearing end 8 has sufficient rigidity to allow the opening of the opening area 1 when pressed in the direction of the arrow F3 or even better, from the outside of container C toward its inside.

These variations in the flexibility and elasticity of the various parts of the tab 3, 4, 8 are one of the important characteristics of this invention.

The closing/opening area 7, more or less identical to the area delimited by cutout 1, can be warped to assume a concave shape and a convex shape alternately.

Groove 5 includes an annular elastic seal 6, made for instance, of rubber.

The bearing end 8 of the tab is able to warp the closing/opening area 7 that is more almost identical to the area delimited by the cutout to give it a convex shape once again (FIG. 4) because of the elasticity and flexibility of closing/opening area 7. This warping is due to the fact that a force F4 is applied from the outside to the inside of the container, on the bearing end 8 of the tab (see FIG. 4).

The enlarged area or gripping end also includes a protrusion 9 allowing the gripping end to be raised and to open the container.

The tab 4 may be attached by means of link 3 on contact 2.

Refer to the figures for the description of the alternating opening and closing process of the container according to this invention.

Figure 2:
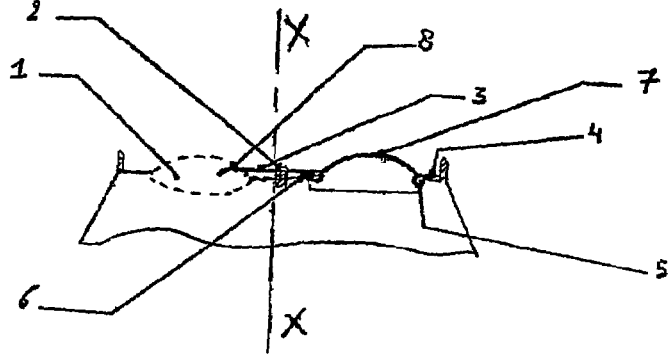
FIG. 2 is a sectional view of the container lid according to the invention, in the open position.

In FIG. 1 and FIG. 2, a container is shown in its original condition, that is, closed, as sold in the trade. Opening area 1 is closed and delimited by a cutout 10. This cutout 10 is preformed by a groove, preformed in lid C. On lid C, tab 3, 4, 8 is attached. Tab 3, 4, 8 is attached by means of a contact 2 at some distance from cutout 10, outside the opening area 1. Tab 3, 4, 8 is placed parallel to lid C and in such a way as not to be inclined with respect to the lid when the container is closed. To open the container, the user raises gripping end 4 to separate it from the lid, causing the tab to tilt in such a way that its bearing end 8 applies force to the opening area 1, which pushes into the container. This causes the container to assume the open position. During this step, closing/opening area 7 is convex, that is, curved toward the outside of the container. The user simply needs to raise the gripping end 4 with a fingernail and does not need to act on the actual closing/opening area 7.

Figure 3:
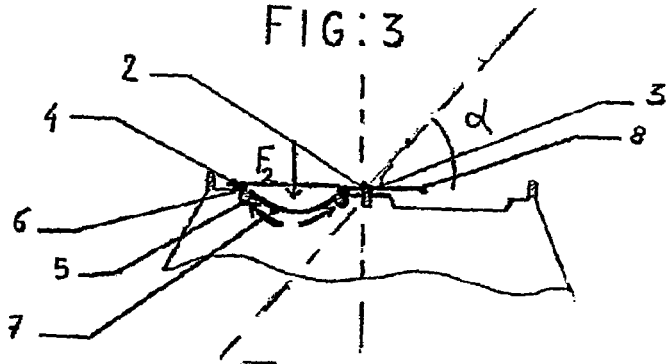
FIG. 3 is a sectional view of the container lid according to the invention in the closed position.

To close opening 1, the user swivels tab 3, 4, 8 7 about vertical contact 2 to turn it through 180° so that the gripping end 4 is moved opposite opening area 1, as shown in FIG. 3. The user then presses the closing/opening area 7, from the top downwards (or from the outside toward the inside of the container), in the direction of arrow F2. The closing/opening area 7 is then warped and becomes concave. Its edges move apart slightly and area 7 then becomes slightly larger than opening area 1, allowing the forceful penetration of concave area 7 into opening area 1. Seal 6 provides tightness.

Figure 4:
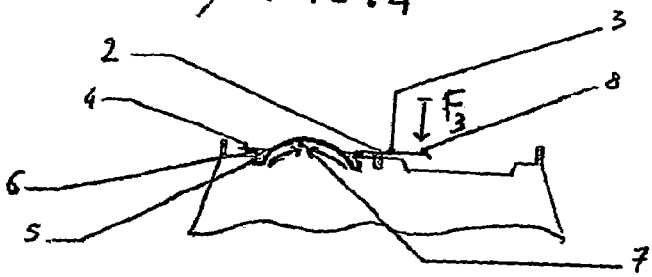
FIG. 4 is a sectional view of the container lid according to the invention, in the closed position, just before opening.

To open the recipient again, the user presses gripping end 8, from top to bottom, in the direction of the arrow F3 (FIG. 4). Because of the elasticity of the closing/opening area 7, it is warped under the action of the thrust, resumes its original convex shape, and its edges retract, having the effect of separating the closing/opening area 7 from the edges of opening area 1. The user may then easily grasp the protrusion 9 provided on the gripping end 4 so as to raise tab 3, 4, 8 and swivel it once again about contact 2.

The invention claimed is:

1. A container comprising a bottom, a lid and a vertical wall joining the bottom to the lid, a tab including a gripping end and opposed bearing end, said tab comprising a protrusion between its gripping end and its bearing end, made integral by means of said protrusion with the lid by means of a contact having a longitudinal axis running parallel to the longitudinal axis of container, said contact being attached to the lid, said tab being able to be turned about a longitudinal axis of contact and being suitable for inclining through a given angle with respect to the plane of the lid, with an opening area delimited by a cutout in said lid and that may be opened by means of said tab whose bearing end applies force from the outside toward the inside of the container inside area delimited by the cutout, wherein said tab has a gripping end which is enlarged with respect to the shape of the opening area delimited by the cutout and a closing/opening area about the same size as the opening area delimited by cutout with the closing/opening area delimited by a groove and whose closing/opening area is originally convex and which, because of its flexibility and elasticity, may be warped by pressure from the outside to the inside of the container in order to assume a concave shape and, conversely, which may be warped to resume its convex shape by pressure from the inside to the outside of the container applied on the bearing end.

2. A container according to claim 1 wherein said contact attaching link is spaced from said cutout.

3. A container according to claim 1, wherein said groove contains a seal.

4. A container according to claim 1, wherein the gripping area also includes an external protrusion which, after the bearing end of the tab has warped opening said closing area causes it to assume a convex shape, allows the gripping end to be raised and, thereby, to open the container.

5. A process for opening and closing a container claim 1, comprising the following steps:

a) a bearing end of the tab is placed above cutout area;

b) the tab is raised from the inside to the outside of the container so that bearing end forces cutout area to open;

c) the tab is made to swivel about the longitudinal axis of contact so that the convex closing/opening area is brought opposite area delimited by the cutout;

d) the convex closing/opening area of the tab is pushed from the outside to the inside so that it assumes a concave shape;

c) the convex closing/opening area is locked into the opening cutout area so as to close it.

6. A process for opening a container that is opened and closed according to claim 5, further comprises the following steps:

f) the bearing end of the container is pushed from the outside to the inside so as to warp the concave closing/opening area to restore its initial convex shape; and g) the gripping end is raised by means of a protrusion to release the gripping end and the open cutout area.

7. A process according to claim 6, further comprising repeating steps c) to g).

* * * * *